US006312218B1

(12) United States Patent
Beeck et al.

(10) Patent No.: US 6,312,218 B1
(45) Date of Patent: Nov. 6, 2001

(54) SEALING ARRANGEMENT

(75) Inventors: Alexander Beeck, Küssaberg (DE); Mohamed Nazmy, Fislisbach (CH); Bernhard Weigand, Lauchringen (DE)

(73) Assignee: Asea Brown Boveri AG, Baden (CH)

( * ) Notice: Subject to any disclaimer, the term of this patent is extended or adjusted under 35 U.S.C. 154(b) by 0 days.

(21) Appl. No.: 09/414,968

(22) Filed: Oct. 12, 1999

(30) Foreign Application Priority Data

Oct. 19, 1998 (DE) ..... 198 48 103

(51) Int. Cl.[7] ..... F01D 11/00
(52) U.S. Cl. ..... 415/173.7; 416/193 A
(58) Field of Search ..... 415/170.1, 173.1, 415/173.7; 416/193 A, 248; 277/628, 653, 637, 650, 654, 941

(56) References Cited

U.S. PATENT DOCUMENTS

| | | | | |
|---|---|---|---|---|
| 5,104,286 | * | 4/1992 | Donlan | 415/170.1 |
| 5,328,328 | | 7/1994 | Charbonnel et al. . | |
| 5,509,669 | * | 4/1996 | Wolfe et al. | 277/167.5 |
| 5,531,457 | * | 7/1996 | Tibbott et al. | 277/53 |
| 5,586,773 | * | 12/1996 | Bagepalli et al. | 277/167.5 |
| 5,622,474 | * | 4/1997 | Werner et al. | 415/173.1 |
| 5,820,338 | | 10/1998 | Kasprow et al. . | |
| 5,865,600 | * | 2/1999 | Mori et al. | 416/198 A |

FOREIGN PATENT DOCUMENTS

| | | |
|---|---|---|
| 2108176 | 8/1972 | (DE) . |
| 3303482A1 | 8/1983 | (DE) . |
| 19520268A1 | 12/1996 | (DE) . |
| 0501700A1 | 9/1992 | (EP) . |

* cited by examiner

*Primary Examiner*—Edward K. Look
*Assistant Examiner*—Ninh Nguyen
(74) *Attorney, Agent, or Firm*—Burns, Doane, Swecker & Mathis, L.L.P.

(57) ABSTRACT

Described is a sealing arrangement for reducing leakage flows inside a rotary fluid-flow machine, preferably an axial turbomachine, having moving and guide blades, which are in each case arranged in at least one moving- or guide-blade row respectively and have blade roots, via which the individual moving and guide blades are connected to fastening contours. A sealing element having felt-like material is provided between at least two adjacent blade roots within a guide- or moving-blade row or between guide and/or moving blades and adjacent components of the fluid-flow machine.

11 Claims, 3 Drawing Sheets

SEALING ARRANGEMENT

The invention relates to a sealing arrangement for reducing leakage flows inside a rotary fluid-glow machine.

BACKGROUND OF THE INVENTION

Sealing arrangements of the generic type are sufficiently known and serve to provide a largely gastight connection between moving blades or guide blades, which are firmly arranged next to one another and are used in rotary turbomachines for the compression or expansion of gaseous media.

Seals are known which consist of a sealing surface with or without a spring element and are inserted into a sealing-groove contour correspondingly provided in the moving- or guide-blade root. In this case, the spring element produces an applied pressure and positions the sealing surface between the contours to be sealed. In static gas turbine components carrying hot gas, such as turbine guide blades, heat-accumulation segments or combustion-chamber segments, such seals serve to reduce the consumption of cooling air, to prevent axial gap flows with hot gas, and to screen against heat radiation.

EP 0 501 700 A1 discloses a turbine guide-blade construction whose guide-blade root and head band are fixed against corresponding contours of the casing components by means of spring sealing elements 52, 54 (in this respect see FIG. 3 of the publication). The disadvantage of seals provided with spring elements consists, inter alia, in the fact that very rapid fatigue of the spring material on account of the extremely high material stresses in view of the temperature and pressure conditions prevailing in gas turbines cannot be ruled out, so that the spring material loses its spring force and thus its sealing function.

Furthermore, DE 195 20 268 A1 discloses a surface seal which has two sealing surfaces, which in each case enclose an elastic corrugated area. In the exemplary embodiment according to FIG. 5 of the publication cited, the surface seal 11, made in the shape of a U, extends along the inner contour of a guide-blade root designed in the shape of a hammer head and serves to seal off cooling air which is blown into the guide blade as well as to protect the guide-blade root from hot gases. However, the sealing arrangement, to be designed in different surface shapes, requires flat contour surfaces to be sealed off, against which it can bear over the flat area. If intermediate gaps which are enclosed by curved surfaces are to be sealed off, the known sealing arrangement encounters its limits.

SUMMARY OF THE INVENTION

Accordingly, one object of the invention is to design a novel sealing arrangement for reducing leakage flows inside a rotary fluid-flow machine, preferably an axial turbomachine, having moving and guide blades, which are in each case arranged in at least one moving- or guide-blade row respectively and have blade roots, via which the individual moving and guide blades are connected to fastening contours, in such a way that the sealing arrangement can be fitted between gap intermediate spaces of any shape. Furthermore, the sealing arrangement is to consist of a material which, in view of the high temperatures and pressure conditions, endures without damage the operating conditions prevailing in a gas-turbine plant.

A sealing arrangement according to the invention is designed in such a way that a sealing element having felt-like material is provided in the intermediate space of two adjacently attached blade roots within a guide- or moving-blade row or between guide and/or moving blades and adjacent components of the fluid-flow machine.

The idea underlying the invention is the use of a felt-like material which is known per se, consists of pressed-together, sintered intermetallic fibers and is specifically inserted into the intermediate space of two guide- or moving-blade roots for reducing the gas exchange between two adjacent blade roots.

Felt-like materials which are based on intermetallic fibers can endure temperatures of over 1000° C. without damage, since the intermetallic fibers have high heat resistance. In addition, they have high oxidation resistance and advantageous heat-conducting properties. Furthermore, these properties can be specifically set by the intermetallic fibers selected and can be adapted to the respective conditions. There is also the fact that a fine-grained structure having porosity which can be specifically set and associated elasticity is possible by suitable selection of the intemetallic fibers used during the production of the felt-like material.

The intermetallic fibers preferably consist of an intermetallic phase on an aluminum, iron or nickel basis or an alloy of the aforesaid constituents.

The geometry with which such materials are inserted into the intermediate space of two adjacent blade roots or in the intermediate space between leading blade edge and combustion-chamber segment can be produced at the manufacturing stage of such materials. Thus the sealing elements according to the invention are of strand-like design and, depending on the cross-sectional shape of the intermediate space to be sealed off between two adjacent blade roots, have different strand cross sections, for example cross sections of rectangular, angled or cross-like design.

The sealing element of strand-like design is preferably firmly attached to at least one blade root at a suitable point, for example by adhesive bonding, brazing or welding. However, it is also possible to fit the material of felt-like design in an accurate manner in appropriately provided fitting grooves.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
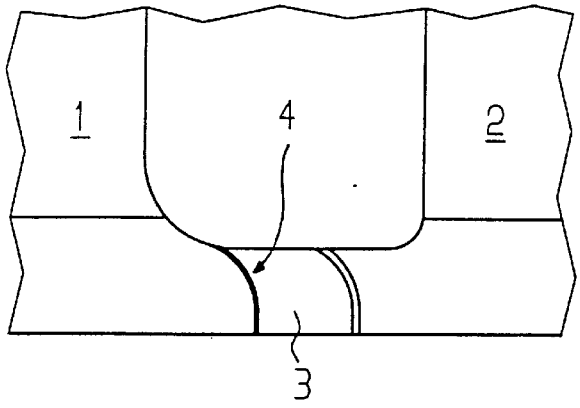
FIG. 1 shows a partial cross-sectional representation through two adjacent blade roots with felt-like material inserted into an intermediate space.

Referring now to the drawings, wherein like reference numerals designate identical or corresponding parts throughout the several views, in FIG. 1 two blade roots 1, 2, in a highly schematic manner, are located adjacently opposite one another and are arranged, for example, in a guide- or moving-blade row. A sealing element 3, consisting of a felt-like material, is provided in the intermediate space between both blade roots. The sealing element 3 is adapted true to shape to the surface contours of both blade roots 1 and 2, so that the seal seals off both blade roots 1 and 2 relative to one another in a gastight manner.

In order to facilitate fitting of the blade roots in corresponding recesses in casing parts of the turbine plant, the sealing element 3 is firmly connected to one blade root. This is preferably effected by means of a brazed, adhesively bonded or welded joint.

In the case of the exemplary embodiment according to FIG. 1, the sealing element 3 is firmly joined to the blade root 1 along its contact contour 4.

Figure 2B:
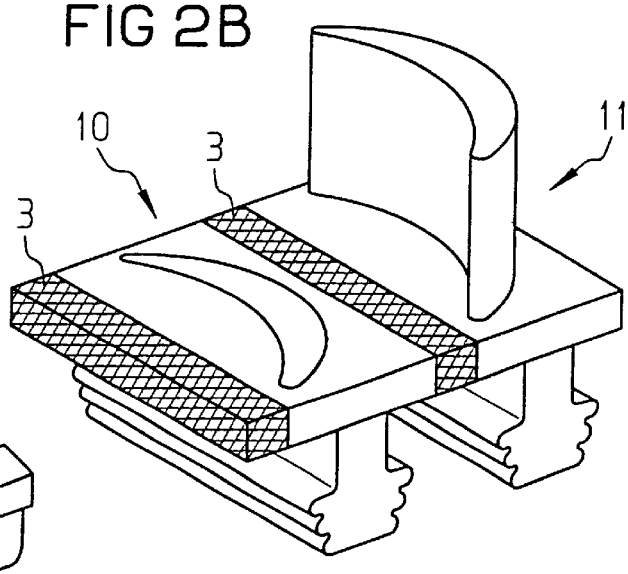
FIGS. 2A and B show a perspective representation of in each case two adjacent moving and guide blades.
Figure 2A:
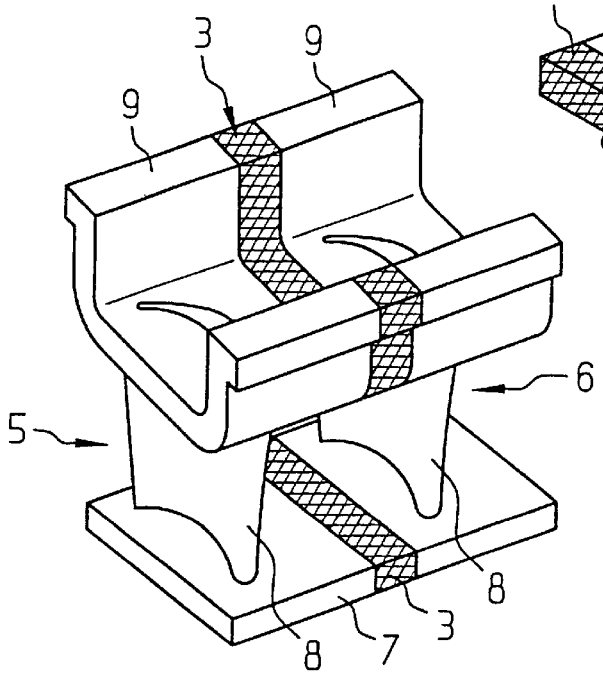

Shown in perspective representation in FIG. 2*a* are two guide blades 5 and 6, which are arranged next to one another and which each have a head band 7, a guide-blade body 8 and a guide-blade root 9. A sealing element 3 suitably adapted to the intermediate space and consisting of felt-like material is provided in each case between the opposite head bands 7 of the guide blades 5 and 6 and the opposite guide-blade roots 9.

Shown in FIG. 2B are two moving blades, 10, 11—only for reasons of clarity the moving-blade body of the moving blade 10 is not shown—which are arranged next to one another and between which the sealing elements 3 according to the invention are likewise provided in the top region of the moving-blade roots.

Figure 3A:
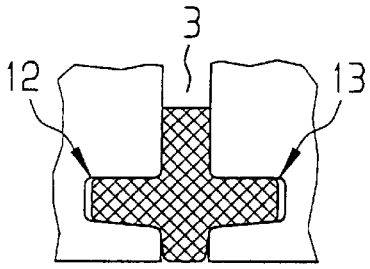
FIGS. 3A, B, C, D and E show material, exemplary embodiments of the sealing element according to the invention.
Figure 3B:
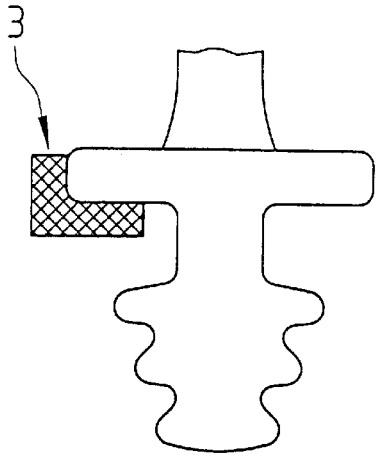
Figure 3C:
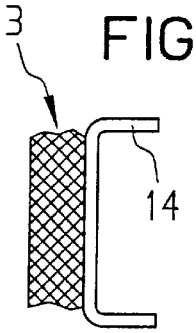

A multiplicity of sealing elements of different shapes are shown in FIGS. 3A to 3B. Thus the sealing element 3 in FIG. 3A projects into two opposite grooves 12, 13 of in each case two adjacent blade roots. In FIG. 3B, the sealing element 3 encloses both a vertical contact surface of the moving-blade root shown and part of the bottom horizontal bearing surface. FIG. 3C shows a sheet-metal structure 14 for fastening purposes, to the vertical flank of which a sealing element 3 provided from the felt-like material is attached. In addition to the brazed, adhesively bonded and welded joints specified, the sealing element 3 may also be attached to corresponding contact surfaces by means of detachable connections, such as screwed connections for example.

Figure 3D:
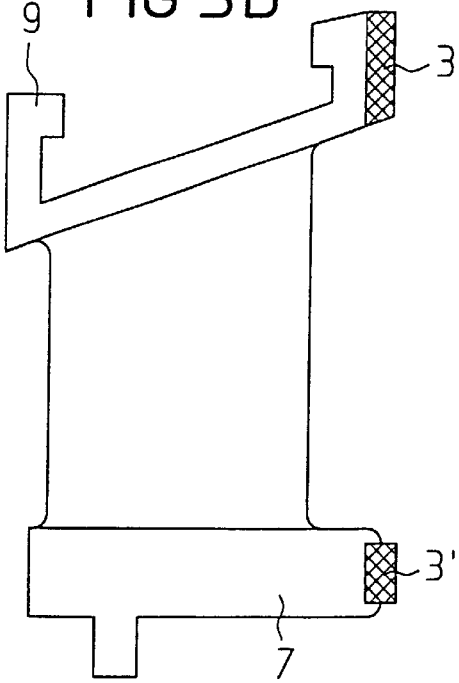
Figure 3E:
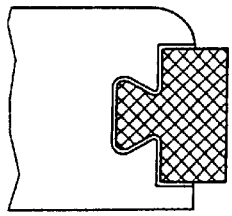

Shown in FIG. 3D is a side view through a guide blade which has in the region of the guide-blade root 9 a sealing element 3 which is butt-brazed to a flat side face. In the region of the head band 7 of the guide blade, the felt-like sealing element 3' sits in a corresponding groove-shaped recess within the head band. Such grooves may also, be made in a dovetail shape, as shown in FIG. 3E. In this case, the sealing element 3 can be pushed laterally into the dovetail-like recess or can be removed therefore laterally again.

Figure 4:
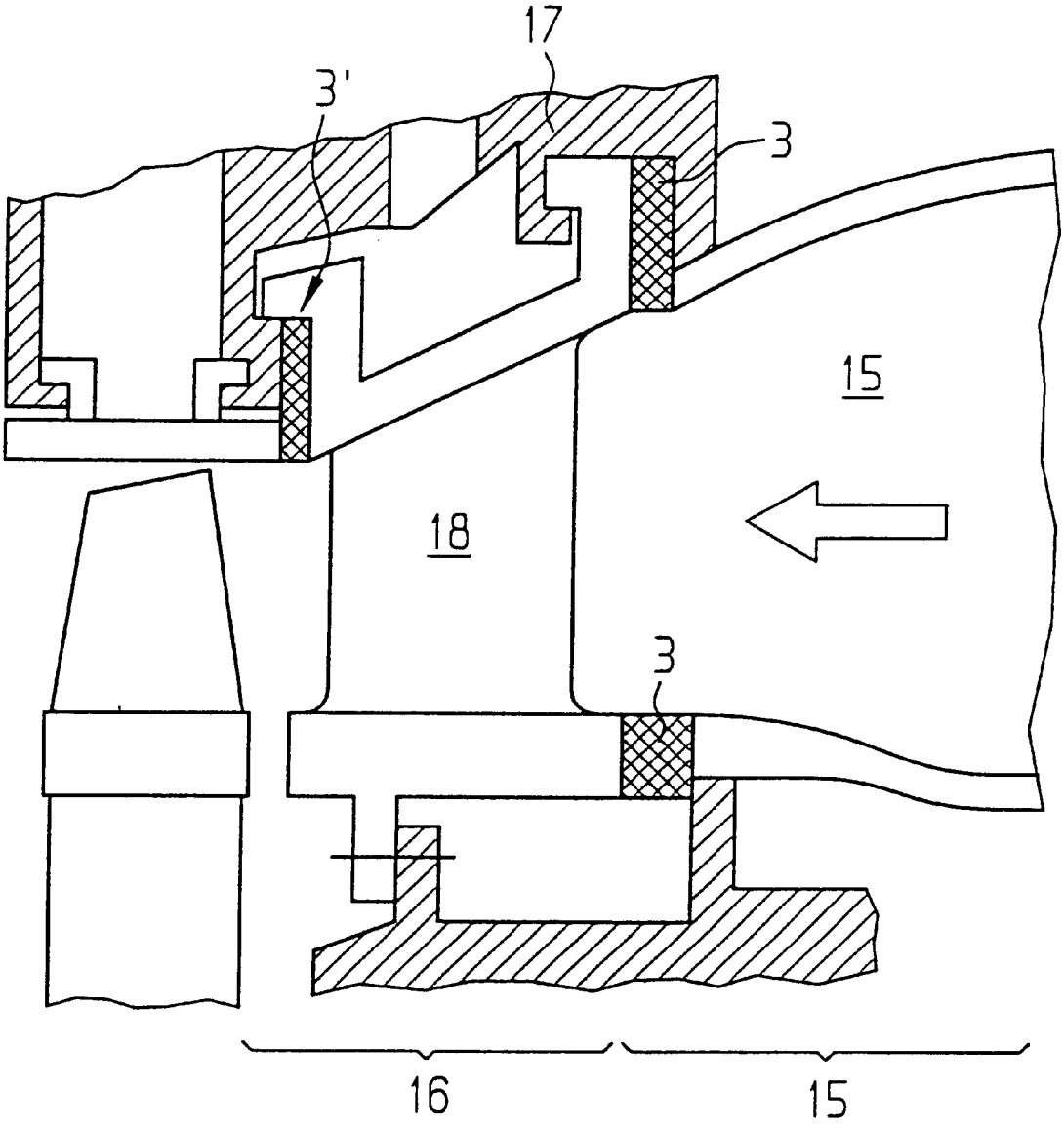
FIG. 4 shows a cross-sectional representation through a gas-turbine plant in the region of the combustion-chamber outlet and turbine inlet.

A cross section through a turbine plant in the region of the combustion-chamber outlet 15 and turbine inlet 16 is shown in FIG. 4. Provided between the turbine casing 17 and the combustion-chamber outlet 15 are sealing elements 3, which prevent the ingress of hot gases into the intermediate space between the casing 17 and the first guide blade 18. Likewise, a further sealing element 3' seals off the lateral intermediate space between guide-blade root and casing 17 in a gastight manner.

The sealing arrangement according to the invention, consisting of felt-like material which is designed like an intermetallic felt, may in principle be fitted in intermediate spaces wherever a gas flow is to be prevented therein. On account of the high oxidation resistance and the high resistance to mechanical deformations, this intermetallic felt based on aluminides or nickel aluminides is especially suitable for use in gas turbines, in which high temperature conditions and high pressure ratios prevail.

Obviously, numerous modifications and variations of the present invention are possible in light of the above teachings. It is therefore to be understood that, within the scope of the appended claims, the invention may be practiced otherwise than as specifically described herein.

What is claimed is:

1. A sealing arrangement for reducing leakage flows inside a rotary fluid-flow machine having moving and guide blades, which are in each case arranged in at least one moving- or guide-blade row respectively and have blade roots by which the individual moving and guide blades are connected to fastening contours, wherein a sealing element having felt-like material is provided between at least two adjacent blade roots within a guide- or moving-blade row and wherein the felt-like material is an intermetallic felt, which is composed of pressed-together and sintered intermetallic fibers.

2. The sealing arrangement as claimed in claim 1, wherein the sealing element is located on both sides to outer contours of the adjacent blade support member in a positive-locking manner.

3. The sealing arrangement as claimed in claim 1, wherein the sealing element is firmly connected to a least one blade root.

4. The sealing arrangement as claimed in claim 3, wherein the connection is a brazed or adhesively bonded joint.

5. The sealing arrangement as claimed in claim 1, wherein the intermetallic fibers consist of an intermetallic phase on an aluminum, iron or nickel basis or an alloy of these constituents.

6. The sealing arrangement as claimed in claim 1, wherein the felt-like material is porous, so that cooling air can pass through the material.

7. A sealing arrangement for reducing leakage flows in a rotary fluid-flow machine having a plurality of blades supported by a support member, the support member of adjacent blades being spaced apart from each other by a gap, the sealing arrangement comprising a sealing element in the gap, the sealing element being in the form of a felt-like material, wherein the felt-like material is an intermetallic felt, which is composed of pressed-together and sintered intermetallic fibers.

8. The sealing arrangement as claimed in claim 7 wherein the rotary fluid-flow machine is a gas turbine, and the blades include moving blades mounted on the turbine rotor.

9. The sealing arrangement as claimed in claim 7 wherein the rotary fluid-flow machine is a gas turbine, and the blades include guide blades mounted on the turbine casing.

10. A sealing arrangement for reducing leakage flows inside a rotary fluid-flow machine having moving and guide blades, which are in each case arranged in at least one moving- or guide-blade row respectively and have blade roots by which the individual moving and guide blades are connected to fastening contours, wherein a sealing element having felt-like material is provided between guide and/or moving blades and adjacent components of the fluid-flow machine wherein the felt-like material is an intermetallic felt, which is composed of pressed-together and sintered intermetallic fibers.

11. The sealing arrangement as claimed in claim 10, wherein the adjacent components of the fluid-flow machine are casing parts or combustion chamber.

* * * * *